United States Patent [19]

Takahashi et al.

[11] Patent Number: 4,938,211

[45] Date of Patent: Jul. 3, 1990

[54] BREATHING APPARATUS

[75] Inventors: Masashi Takahashi; Yasuhiko Satomi; Tadayoshi Iwasaki; Tsuneo Suzuki; Yasunobu Shimada; Shozo Tanaka; Shinji Oshima; Shigeto Suzuki; Seiji Okino; Masahiro Sakamoto, all of Tokyo, Japan

[73] Assignee: Nippon Sanso Kabushiki Kaisha, Tokyo, Japan

[21] Appl. No.: 256,476

[22] Filed: Oct. 12, 1988

[30] Foreign Application Priority Data

| | | | |
|---|---|---|---|
| Oct. 14, 1987 | [JP] | Japan | 62-156989[U] |
| Jan. 20, 1988 | [JP] | Japan | 63-5543[U] |
| Feb. 10, 1988 | [JP] | Japan | 63-16918[U] |
| Mar. 10, 1988 | [JP] | Japan | 63-32043[U] |
| Jul. 18, 1988 | [JP] | Japan | 63-94800[U] |
| Jul. 18, 1988 | [JP] | Japan | 63-94801[U] |
| Jul. 20, 1988 | [JP] | Japan | 63-95884[U] |

[51] Int. Cl.[5] ..... B63C 11/22; B63C 11/24; A62B 7/04; A62B 9/04

[52] U.S. Cl. ..... 128/204.26; 128/205.12; 128/205.13; 128/205.22; 128/201.27; 128/205.74; 128/205.28; 128/207.14; 128/911

[58] Field of Search ..... 128/201.11, 204.18, 128/204.26, 204.27, 204.28, 204.29, 205.12, 205.13, 205.22, 205.23, 200.26, 201.25, 201.26, 201.27, 201.28, 202.14, 205.17, 205.24, 205.27, 205.28, 207.14, 207.17, 207.16, 911

[56] References Cited

U.S. PATENT DOCUMENTS

| | | | |
|---|---|---|---|
| Re. 25,122 | 2/1962 | Page | 128/205.24 |
| 2,045,907 | 6/1936 | Gerson | 128/205.28 |
| 2,073,335 | 3/1937 | Connell | 128/204.18 |
| 2,348,074 | 5/1944 | Lambertsen | 128/205.28 |
| 2,428,425 | 10/1947 | Levitt | 128/207.14 |
| 2,456,130 | 12/1948 | Lambertsen | 128/205.12 |
| 2,872,919 | 2/1959 | Rosset | 128/205.24 |
| 2,897,817 | 8/1959 | Marina | 128/205.17 |
| 3,005,453 | 10/1961 | Wellenstein et al. | 128/204.28 |
| 3,163,707 | 12/1964 | Darling | 128/204.18 |
| 3,402,711 | 9/1968 | Emerson | 128/204.28 |
| 3,680,556 | 8/1972 | Morgan | 128/201.15 |
| 3,710,553 | 1/1973 | Parker et al. | 128/205.28 |
| 3,752,654 | 8/1973 | Johannisson et al. | 128/205.28 |
| 3,910,780 | 10/1975 | Henley et al. | 128/205.28 |
| 3,929,127 | 12/1975 | Paul | 128/205.12 |
| 3,976,063 | 8/1976 | Hennemen et al. | 128/201.25 |
| 4,149,556 | 4/1979 | Schwabe | 128/202.22 |
| 4,152,848 | 5/1979 | Trinkwalder | 128/202.22 |
| 4,250,876 | 2/1981 | Kranz | 128/202.22 |
| 4,266,539 | 5/1981 | Parker et al. | 128/202.22 |
| 4,273,120 | 6/1981 | Oswell | 128/205.24 |
| 4,299,216 | 11/1981 | Bernard et al. | 128/205.17 |
| 4,334,533 | 6/1982 | Henkin | 128/205.28 |
| 4,365,627 | 12/1982 | Wing | 128/202.22 |
| 4,781,184 | 11/1988 | Fife | 128/205.24 |

FOREIGN PATENT DOCUMENTS

| | | | |
|---|---|---|---|
| 8505277 | 12/1985 | PCT Int'l Appl. | 128/205.24 |
| 2005804 | 4/1979 | United Kingdom | 128/205.24 |

*Primary Examiner*—Edgar S. Burr
*Assistant Examiner*—Kimberly L. Asher
*Attorney, Agent, or Firm*—Cushman, Darby & Cushman

[57] ABSTRACT

A breathing apparatus includes: a vessel member having a mouth piece and internal influx chamber; a tubular communication member having opposite ends connected respectively to the intake and outgo ports of the vessel member in such a manner that the vessel member and the communication member define a circular passage for a respirable gas; an oxygen-supplying mechanism for supplying the circular passage with the respirable gas; a pair of check valves, disposed respectively at the intake and outgo ports of the vessel member, for limiting the flow of the respirable gas in the circular passage to a single direction so that, when the person breathes into the influx chamber, the respirable gas in the influx chamber is introduced into the communication member through the outgo port and, when the person inhales through the mouth piece, the respirable gas in the communication member is recycled into the influx chamber through the intake port; and an outlet port for discharging excess respirable gas out of the circular passage. The communication member includes: an inflatable member for receiving the respirable gas upon the person's exhaling, and for releasing the respirable gas to the influx chamber upon the person's inhaling; and carbon dioxide-removing mechanism for removing carbon dioxide from the respirable gas passing through the communication member.

16 Claims, 11 Drawing Sheets

BREATHING APPARATUS

BACKGROUND OF THE INVENTION

This invention relates to a breathing apparatus enabling a person to function in water or irrespirable gases, the breathing apparatus suitable, in particular, for considerably short-time diving in relatively shallow water.

Conventionally, various kinds of breathing apparatuses are used for enabling people to breath in environments in which it is difficult to maintain natural respiration. A typical example of the conventional breathing apparatus is a scuba, i.e., a self-contained under water breathing apparatus which has a regulator connected to an air cylinder generally containing 12 to 14 liters of high-pressure air compressed to about 150 or 200 atmospheres. However, since the scuba enables a person to dive in a water depth, e.g., of more than 30 meters and also to dive for an amount of time, e.g., of more than 30 minutes, it is dangerous for the person to use the scuba without knowing the diving medical science and the diving physics. Moreover, since the scuba weighs no less than 20 kg, and also since it is not easy to handle, the scuba users are required to receive special training in advance of using it. For this reason, it has not been possible for many people to enjoy scuba diving, and thus all that has been readily available to them is snorkelling

SUMMARY OF THE INVENTION

Accordingly, it is an object of the present invention to provide a lightweight, compact and low cost breathing apparatus which is easy to handle.

Another object of the present invention is to provide a breathing apparatus which enables a person to safely go under water to a depth of not more than 5 meters for about 10 minutes without receiving any diving training or a great knowledge of diving.

With these and other objects in view, the present invention provides a breathing apparatus which comprises: a vessel member having a mouth piece and an internal influx chamber communicating with the mouth piece, the vessel member having intake and outgo ports communicating with the influx chamber; communication means having opposite ends connected respectively to the intake and outgo ports of the vessel member in such a manner that the vessel member and the communication means define a circular passage for a respirable gas; oxygen-supplying means for supplying the circular passage with the respirable gas; a pair of check valves, disposed respectively at the intake and outgo ports of the vessel member, for limiting the flow of the respirable gas in the circular passage to a single direction so that, when the person exhales into the influx chamber through the mouth piece, the respirable gas is introduced into the communication means through the outgo port and, when the person inhales through the mouth piece, the respirable gas in the communication means is recycled into the influx chamber through the intake port; and an outlet port for discharging excess respirable gas out of the circular passage. The communication means comprises: inflatable means for receiving the respirable gas when the person exhales the respirable gas into the circular passage, and for releasing the respirable gas to the influx chamber when the person inhales through the mouth piece; and carbon dioxide-removing means for removing carbon dioxide from the respirable gas passing through the communication means.

The circular passage should define a radially inner circular space large enough to loosely receive the person's neck. It is preferred that the oxygen-supplying means comprises an oxygen cartridge containing a high-pressure respirable gas and having an outer size considerably smaller than the vessel member.

The inflatable means may comprise a pair of cylindrical bellows-like flexible tubes longitudinally extensible and contractible. The proximal ends of the flexible tubes are communicatively connected respectively to the intake and outgo ports of the vessel member. The distal ends of the flexible tubes are communicatively connected to each other through the carbon dioxide-removing means. The flexible tubes extend when the flexible tubes receive the respirable gas exhaled by the person into the circular passage, and they contract when the flexible tubes release the respirable gas to the influx chamber.

BRIEF DESCRIPTION OF THE DRAWINGS

In the drawings:

FIG. 16(*b*) is a view taken along the line *b*—*b* in FIG. 16(*a*);

DETAILED DESCRIPTION OF THE PREFERRED EMBODIMENTS

Figure 1:
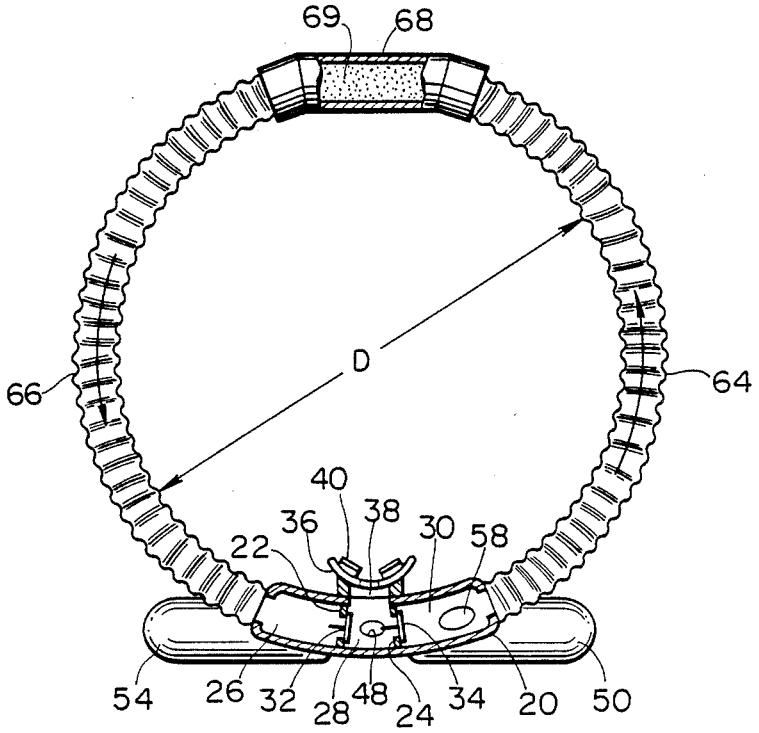
FIG. 1 is a plan view, partly in section, of a breathing apparatus according to the present invention.

Referring now to the drawings, wherein like reference characters designate corresponding parts throughout several views, and descriptions of the corresponding parts are omitted once given.

Figure 2:
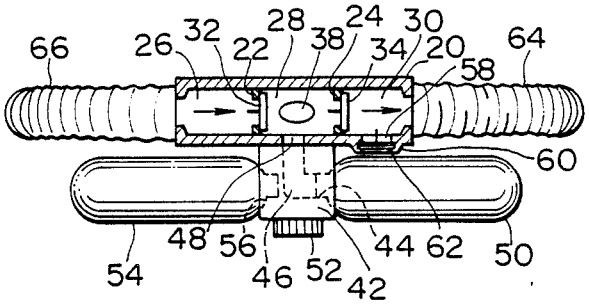
FIG. 2 is a front view, partly in section, of the breathing apparatus in FIG. 1.

FIGS. 1 and 2 illustrate a breathing apparatus according to the present invention, in which reference numeral 20 designates a generally arcuate and tubular vessel member made of a hard plastic. The internal space of the vessel member 20 is divided by a pair of inner walls in the form of annular valve seats 22 and 24 into three longitudinally aligned chambers, namely, an intake chamber 26, an influx chamber 28 and an outgo chamber 30. That is, the influx camber 28 is interposed between the intake and outgo chambers 26 and 30, and is in fluid communication with both the intake and outgo chambers 26 and 30 through the central openings defined by the valve seats 22 and 24. Intake and outgo check valves 32 and 34 are movably disposed respectively on the valve seats 22 and 24 for opening and closing the respective central openings of the valve seats 22 and 24. The intake check valve 32 is urged to the valve seat 22 so that it is normally held in its closed position, and is brought to its opened position when the internal pressure of the influx chamber 28 becomes lower than that of the intake chamber 26. On the other hand, outgo check valve 34 is urged to the valve seat 24 so that it is normally held in its closed position, and is brought to its opened position when the internal pressure of the influx chamber 28 becomes larger than that of the outgo chamber 30. A substantially tubular mouth piece 36 is fixedly connected at its proximal end to the concave side of the vessel member's outer face so that the internal passage 38 of the mouth piece 36 is in fluid communication with the influx chamber 28. The internal passage 38 of the mouth piece 36 is, naturally, open to the distal end face of the mouth piece 36. The reference numeral 40 denotes that portion of the mouth piece 38 adapted to be held between the teeth of a person.

As best shown in FIG. 2, a substantially cubical regulator 42 is attached at its top face to the lower outer face of the vessel member 20. This regulator 42 has an inlet port for oxygenous gas such as air, oxygen and oxygen-enriched air, which is in the form of a threaded hole 44 open to the right side face thereof. The threaded hole 44 is in communication with the influx chamber 28 of the vessel member 20 through both an oxygen-leading passage 46 formed in the regulator 42 and an inlet opening 48 formed in the lower wall of the vessel member 20. A capsule-shaped oxygen cartridge 50 which cooperates with the regulator 42 to form oxygen-supplying means, is threadedly engaged with the inner face of the threaded hole 44 More specifically, the valved and threaded end of the oxygen cartridge 50 is received and retained in the threaded hole 44. That is, the threaded hole 44 is a kind of interface for linking the oxygen cartridge 50 to the regulator 42. Suitable means (not shown) for opening the valved end of the cartridge 50, such as a pin extending coaxially with the threaded hole 44, is disposed within the hole 44 so that, when the valved end of the cartridge 50 is screwed into the hole 44, the pin pushes the valve or sealing disk of the cartridge 50 inward, thereby opening the valve of the cartridge 50. A regulator valve (not shown) is disposed within the oxygen-leading passage 46 in order to regulate the flow rate of oxygenous gas flowing from the cartridge 50 into the influx chamber 28. This regulator valve is one such that it is capable of regulating the flow rate to a prescribed level not more than 2 lit./min. The oxygen consumption of an average person in normal condition is approximately 0.5 lit./min. at atmospheric pressure. Reference numeral 52 designates a rotatable lug operatively connected to the regulator valve. By manually turning the control lug 52, the regulator valve is opened, and the flow rate of oxygenous gas to be supplied to the influx chamber 28 is adjusted to the prescribed level appropriate for a user of this breathing apparatus. Also, reference numeral 54 denotes a spare oxygen cartridge detachably fixed to the regulator 42. The valved end of the spare cartridge 54 is received and retained in a threaded hole 56 which is formed in the left side face of the regulator 42. In addition, by using the oxygen cartridges 50 and 54, each containing 95 ml of oxygen compressed to 190 atmospheres and by adjusting the oxygen flow rate to a level between 1.5 and 1.7 liter/minute, it is possible for an average person to breath for about 36 minutes at atmospheric pressure. That is, under water pressure at a water depth of about 5 m, it may be possible for an average person to breath for about 20 minutes.

Referring further to FIGS. 1 and 2, an outlet port in the form of an opening 58 is formed through the lower wall, as viewed in FIG. 2, of the vessel member 20. That portion of the vessel member 20 around the opening 58 is formed into another valve seat 60, and an outlet check valve 62 is movably disposed on the valve seat 60 for opening and closing the outlet opening 58. This outlet check valve 62 is urged to the valve seat 60 so that it is normally held in its closed position, and is brought to its opened position when the internal pressure of the outgo chamber 30 becomes higher than a preset pressure. The preset pressure is higher than the external pressure of the breathing apparatus, and is, preferably, from 1.1 to 1.6 kg/cm$^2$. A pair of flexible tubes 64 and 66 are hermetically connected at their proximal ends respectively to the opposite ends of the tubular vessel member 20. The distal ends of the flexible tubes 64 and 66 are hermetically and releasably engaged respectively with the opposite ends of a plastic tubular container 68 which contains an absorbent 69 to absorb carbon dioxide. That is to say, the tubular container 68 and the absorbent 69 constitute carbon dioxide-removing means, and the vessel member 20, the flexible tubes 64 and 66 and the absorbent container 68 define a semi-closed circular passage for a respirable gas such as air, oxygen and oxygen-enriched air.

Each of the flexible tubes 64 and 66 is of a bellows-like or corrugated pipe-like configuration and is made of a resilient substance such as natural rubber, synthetic resin and the like. These tubes 64 and 66 include a number of substantially rigid annular ridges arranged at longitudinal intervals. Consequently, the tubes 64 and 66 are substantially incapable of radially expanding and contracting but are longitudinally extensible and contractible as well as being transversely flexible. The lengths and inner diameters of the flexible tubes 64 and 66 are such that the difference between the minimal volume of the flexible tubes 64 and 66 (i.e., the volume of the flexible tubes 64 and 66 in their longitudinally contracted most forms) and the maximal volume of the tubes 64 and 66 (i.e., the volume of the tubes 64 and 66 in their longitudinally extended most forms) is larger than the volume of a normal inhalation or exhalation by an average person in the normal condition. More specifically, the breathing apparatus for an adult should have the differential volume of about 1 to 3 liters, while the breathing apparatus for a child should have the differential volume of about 0.5 to 2 liter. The material and configuration of the flexible tubes 64 and 66 are chosen so that the flexible tubes do not cause the user to feel any difficulty in breathing. Furthermore, the diameter D (see FIG. 1) of the circular passage, that is, the inner diameter of a circular piping (i.e., communication means) constituted by the flexible tubes 64 and 66 and the like, when the tubes 64 and 66 are contracted, is considerably larger than the transverse outer size of an average person's neck, and when the tubes 64 and 66 are extended, is smaller than the shoulder length of an average person.

The carbon dioxide-absorbent 69 encased in the container 68 is composed of the mixture of particles or granules of LiOH, $Ca(OH)_2$, $Ba(OH)_2$, KOH, NaOH and the like. Such an absorbent is, for example, BARALYME manufactured by Allied Healthcare Products Inc. or SODASORB manufactured by W. R. Grace & Co. The absorbent container 68 is sealed at its opposite ends by waterproof filters in order to prevent both the escape of the granular absorbent and the entry of water and the like into the container 68. The amount of the absorbent encased in the container 68 is such that the absorbent can almost completely remove the carbon dioxide exhaled by the user of this apparatus during his breathing of the oxygen contained in the two oxygen cartridges 50 and 54. Since the ventilation resistance of the absorbent container 68 should be as low as possible, the particle size, packing density and cross-sectional area of the container-encased absorbent are such that the absorbent does not cause the user to feel any difficulty in breathing. In addition, when 100 g of SODASORB is charged into the container 68 as an absorbent, it works for approximately 33 minutes at atmospheric pressure since 1 kg of SODASORB is capable of absorbing about 230 liters of carbon dioxide, and an average person exhales 0.7 to 1.5 liters of carbon dioxide per a minute. That is, in the water pressure at a water depth of 5 m, 100 g of SODASORB may work for approximately 20 minutes.

The operation of the breathing apparatus thus constructed will now be described.

First, the oxygen cartridges 50 and 54 and the absorbent 69 are replaced with new ones, and the breathing apparatus is put around the neck of the user. Then, the mouth piece 36 is taken in the user's mouth, and the control valve is opened by turning the lug 52 in order for the person to begin to breath through the mouth piece 36. After that, the user may go into water or irrespirable gases.

When the user breathes out, the outgo check valve 34 is brought to its opened position, and thereby the mixture of the exhalation breathed by the user and the oxygenous gas discharged from the cartridge 50, flows into the outgo chamber 30 through the influx chamber 28. The mixed gas of the exhalation and the oxygenous gas is subsequently led into the flexible tubes 64 and 66, thereby inflating and extending the tubes 64 and 66. When the mixed gas passes through the absorbent container 68, the carbon dioxide contained in the mixed gas is absorbed by the absorbent 69, and thereby the carbon dioxide is removed from the mixed gas. When the volume of exhalation is large enough to extend the flexible tubes 64 and 66 to their maximum lengths, the outlet check valve 62 is brought to its opened position, and thereby the excess gas in the circular passage is discharged outside from the opening 58. On the other hand, when the user tries to breathe in, the outgo check valve 34 is brought back to its closed position, and instead, the intake check valve 32 is brought to its opened position. Therefore, the mixed gas in the flexible tubes 64 and 66 is introduced into the influx chamber 28 through the intake chamber 26, and is inhaled by the user together with the oxygenous gas discharged from the cartridge 50. Upon this inhaling of the mixed gas, the flexible tubes 64 and 66 longitudinally contract to be ready for the subsequent exhaling Thereafter, exhaling and inhaling can be alternately repeated in the same manner as described above. Accordingly, by using this breathing apparatus, it is possible for a person to breath normally in water or irrespirable gases. In particular, since this breathing apparatus has the oxygen supplying means which is not employed in the usual respirator, it has the advantage that it can be used in an environment which includes no oxygen.

Before the oxygenous gas in the cartridge 50 runs out, the user should come out of the water or the irrespirable gases to replace the cartridge 50 with the spare cartridge 54. By using the spare cartridge 54, it is possible for the user to go again under the water or into the irrespirable gases. In addition, the amount of oxygenous gas remaining in a cartridge 50 or 54 can be easily known since the flow rate of the oxygenous gas discharged from the cartridge varies depending on the amount of the residual oxygenous gas in the cartridge. Even if the oxygenous gas in both the cartridges 50 and 54 runs out during the diving, the user can safely come back from the water at a depth of 5 m to the water surface by breathing the oxygen remaining in the circular passage.

In this breathing apparatus, since the exhalation breathed by the user is recycled through the carbon dioxide-removing means 68 and 69, the oxygen discharged from the cartridge is efficiently utilized Therefore, despite the small size oxygen cartridges 50 and 54, the breathing apparatus enables a user to function in water or irrespirable gases for a satisfying amount of time. Also, since the amount of the mixed gas discharged from the apparatus per unit time is considerably less than that discharged from a scuba, the exhaust sound of the breathing apparatus is considerably lower than that of the scuba. Furthermore, since the breathing apparatus according to the present invention has a buoyancy, due to its structure, of more than 1 kgf, it is possible to let the apparatus float on the water surface, and thus it is easy for the user to swim with the apparatus around his neck. That is, the apparatus has the excellent advantage of enabling those who have not received diving training to enjoy safe and easy diving.

As the oxygenous gas, pure oxygen, air or oxygen enriched nitrogen may be used. In addition to the mouth piece 36, a fitting which covers the nose and mouth of a person may be attached to the vessel member 20. Instead of the absorbent container 68 arranged between the flexible tubes 64 and 66, a container directly connected to the outgo chamber side of the vessel member 20 may be used in order to reduce, upon the user's inhaling, the ventilation resistance of the circular passage. Also, instead of the oxygen-supplying means disposed on the vessel member 20, an oxygen-supplying means connected to that portion of the flexible tube 64 or 66 diametrically opposing to the vessel member 20 may be employed. In place of the threaded holes 44 and 56, holes having annular ridges on their inner faces thereby being resiliently engageable with the valved ends of the cartridges, may be employed. Furthermore, suitable means for fastening the apparatus to a person's body, such as a strap and a band, may be employed. For example, straps or bands should be attached at their ends to that portion of the apparatus adjacent to the absorbent container 68 so that it is possible to loosely fasten the absorbent container 68 to the person's chest or shoulder with the straps or bands.

Figure 3:
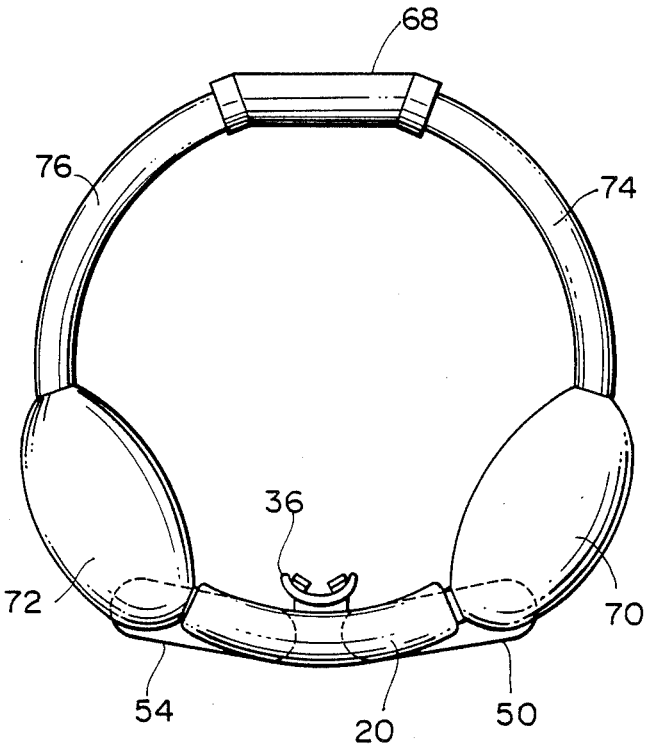
FIG. 3 is a plan view of a modified form of the breathing apparatus in FIG. 1.

FIG. 3 illustrates a modified form of the breathing apparatus in FIG. 1, in which a pair of flexible plastic air bags 70 and 72 are employed in place of the flexible tubes 64 and 66. More specifically, the inflatable air bags 70 and 72 are communicatively connected respectively to the opposite ends of the tubular vessel member 20, and a pair of hard plastic arcuate pipes 74 and 76 interconnect the respective air bags 70 and 72 with the absorbent container 68. The air capacity of these air bags 70 and 72 is generally equal to that of the flexible tubes 64 and 66 in the foregoing embodiment. Since the hard plastic pipes 74 and 76 maintain a predetermined minimum space within the circular piping (that is, the piping constituted of the vessel member 20, air bags 70 and 72, plastic pipes 74 and 76 and the container 68), there is no possibility of the piping choking the neck of the user upon the user's inhaling.

Figure 4:
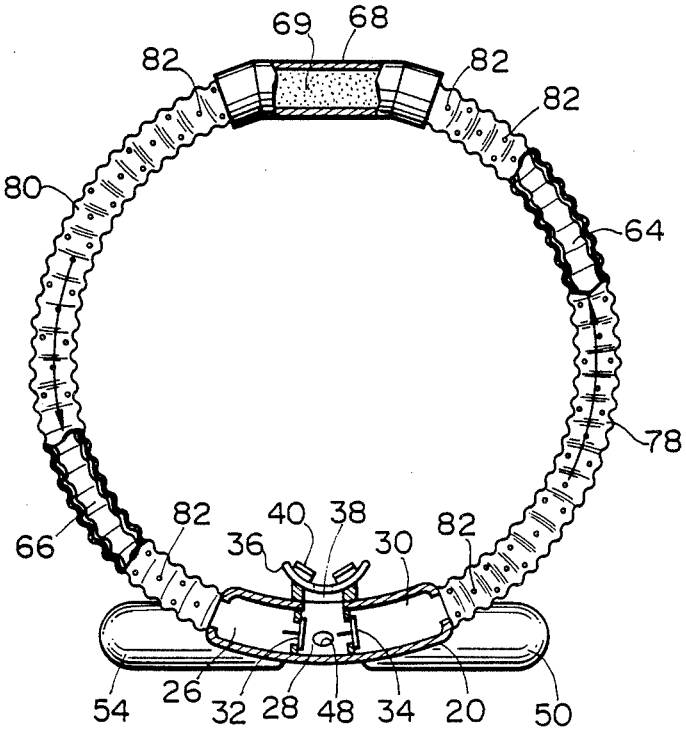
FIG. 4 is a plan view, partly in section, of another modified form of the breathing apparatus in FIG. 1.
Figure 5:
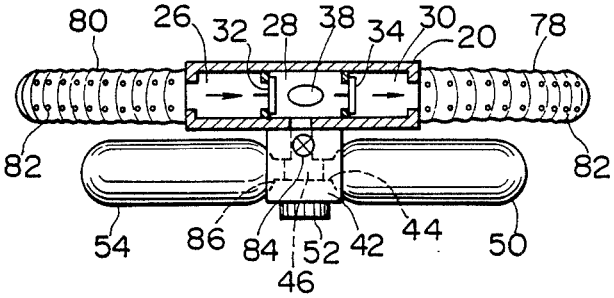
FIG. 5 is a front view, partly in section, of the breathing apparatus in FIG. 4.

FIGS. 4 and 5 illustrate another modified form of the breathing apparatus shown in FIGS. 1 and 2, in which flexible tubes 64 and 66 are coaxially covered with outer safeguard tubes 78 and 80 respectively. Each of these safeguard tubes 78 and 80 is of a bellows-like or corrugated pipe-like configuration, thus being longitudinally extensible and contractible as well as being transversely flexible. Each of the safeguard tubes 78 and 80 has numerous through apertures 82 formed in its tube wall, allowing fluid such as water and gases to pass therethrough to let the corresponding flexible tube inside undergo water or atmospheric pressure. Therefore, when the user breathes through the mouth piece 36, the safeguard tubes 78 and 80 longitudinally extend and contract together with the flexible tubes 64 and 66, and thus do not hamper the user's breathing. The through apertures 82 are arranged on the tubes 78 and 80 in an organized manner, and each of the through apertures 82 has a inner diameter of approximately 5 mm. Since these safeguard tubes 78 and 80 are employed to mechanically protect the flexible tubes 64 and 66, it is preferred that the tubes 78 and 80 are made of material having a higher mechanical strength than the material forming the flexible tubes 64 and 66. Needless to say, the lengths of the safeguard tubes 78 and 80 are long enough to maintain the space within the circular piping for receiving the user's neck. Reference numeral 84 denotes an outlet check valve, disposed on a regulator 42, for discharging excess air outside. Reference numeral 86 designates an auxiliary inlet port in the form of a threaded hole. This threaded hole 86 is in fluid communication with an oxygen-leading passage 46 in the regulator 42. Suitable means for alternatively connecting the threaded holes 44 and 86 to the oxygen-leading passage 46, such as a diverter valve (not shown) is interposed between the threaded holes 44 and 86. This diverter valve is operatively connected to a control lug 52. Therefore, by turning the lug 52, it is possible not only to open and close the regulator valve but also to select one of the cartridges 50 and 54 from which respiratory oxygen is discharged into the influx chamber 28.

Figure 6:
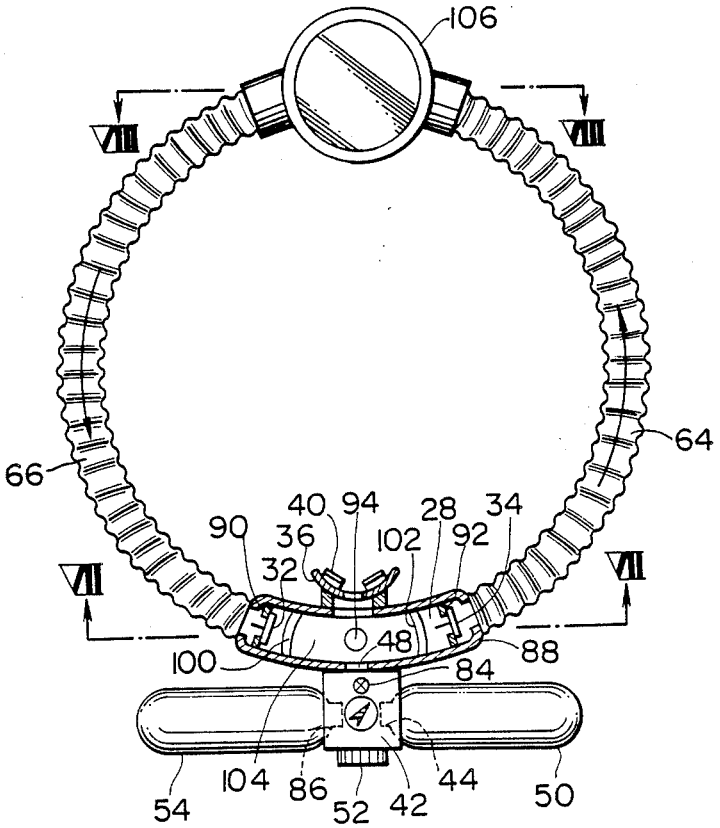
FIG. 6 is a plan view, partly in section, of another embodiment of the present invention.
Figure 7:
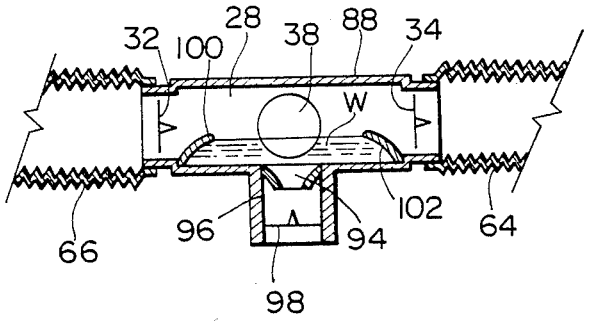
FIG. 7 is a view taken along the line VII—VII in FIG. 6.

FIGS. 6 to 9 show another embodiment of the present invention. As best shown in FIGS. 6 and 7, an arcuate vessel member 88 has an influx chamber 28. A pair of annular valve seats 90 and 92 are disposed respectively within the opposite end portions of the vessel member 88, and intake and outgo check valves 32 and 34 are movably disposed on the valve seats 90 and 92 respectively. A regulator 42 is connected to the convex side of the outer face of the vessel member 88 to supply oxygenous gas in cartridges 50 and 54 into the influx chamber 28. In this embodiment, no diverter valve is disposed in the oxygen-leading passage in the regulator 42, and thus both the threaded holes 44 and 86 are continuously in fluid communication with the oxygen-leading passage In the lower wall, as viewed in FIG. 7, of the vessel member 88, there is formed a purging port in the form of a purging opening 94 which is in communication with a purging pipe 96 connected to the lower outer face of the vessel member 88. A purging check valve 98 is movably disposed on the lower open end of the purging pipe 96 to open and close the purging opening 94. That is, the purging check valve 98 is normally held in its closed position, and is brought to its opened position when the internal pressure of the influx chamber 28 becomes higher than a preset pressure. This preset pressure is higher than the external pressure of the breathing apparatus, and is, preferably, from 1.1 to 1.6 $kg/cm^2$. Cofferdam walls 100 and 102 are disposed on the lower inner face of the vessel member 88 in such a manner that the cofferdam walls 100 and 102 substantially surround the purging opening 94 and define a water receiver section 104 within it. As shown in FIG. 7, this water receiver section 104 is adapted to gather water W accidentally coming into the influx chamber 28 through a mouth piece 36.

Figure 8:
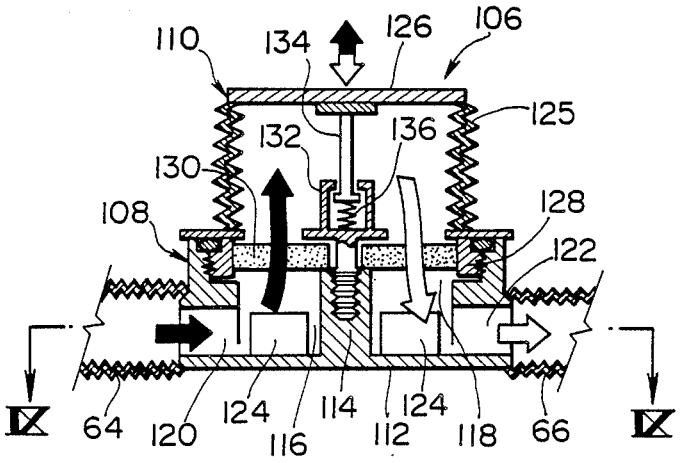
FIG. 8 is a view taken along the line VIII—VIII in FIG. 6.
Figure 9:
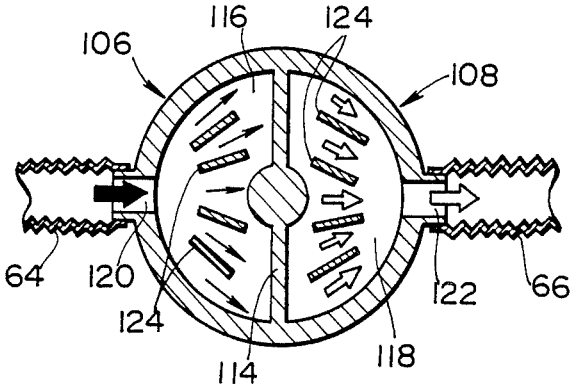
FIG. 9 is a view taken along the line IX—IX in FIG. 8.

As best shown in FIGS. 8 and 9, a carbon dioxide-removing means or mechanism 106 is interposed between the distal ends of the flexible tubes 64 and 66. This mechanism 106 includes a substantially cylindrical container 108 and a substantially cylindrical inflatable cover member 110 coaxially connected to the open top end of the container 108. On the bottom wall 112 at the closed end of the container 108, there is disposed a partition wall 114 dividing the internal space of the container 108 into semi-cylindrical inflow and outflow chambers 116 and 118. The inflow chamber 116 has an inlet 120 formed in the cylindrical side wall of the container 108 and detachably connected to the flexible tube 64. In other words, the inflow chamber 116 is in communication with the inside of the flexible tube 64 through the inlet 120. While on the other hand, the outflow chamber 118 has an outlet 122 formed in the side wall of the container 108 and detachably connected to the flexible tube 66. That is, the outflow chamber 118 is in communication with the inside of the flexible tube 66 through the outlet 122. A plurality of guide fins 124 are disposed on the bottom wall 112 at each of the chambers 116 and 118. These fins 124 extend in directions substantially intersecting the partition wall 114 in such a manner that the distance between any two adjoining fins 124 is gradually lengthened toward the partition wall 114.

Referring to FIG. 8, the inflatable cover member 110 has a cylindrical bellows-like side wall 125 and an end plate 126 closing one of the opposite ends of the side wall 125. Also, a ring-shaped cap 128 is coaxially fixed to the other end of the side wall 125. This cap 128 has a disc-shaped absorber plate 130 made of a carbon dioxide absorbent coaxially fitting therein This cap 128 has a thread formed on the outer peripheral face thereof, and is screwed into the open end of the container 108. As a result, the inflatable cover member 110 is hermetically engaged with the container 108 in such a manner that the upper edge of the partition wall 114 is directly in contact with the lower face of the absorber plate 130. Reference numeral 132 denotes an elongated support member coaxially disposed in the cover member 110. This support member 132 passes through the absorber plate 130 and is embedded at its lower end in the partition wall 114. A sliding rod 134 is slidably connected to the upper end of the support member 132 for axial movement. The upper end of the sliding rod 134 abuts against the lower face of the end plate 126. Urging means in the form of a coil spring 136 is interposed between the sliding rod 134 and the support member 132 so as to urge the sliding rod 134 toward the end plate 126. Accordingly, the end plate 126 is normally urged by the coil spring 136 away from the absorber plate 130, and thereby, normally, the inflatable cover member 110 is axially extended to its substantially maximum length.

When the user exhales into the influx chamber 28, the mixed gas of the exhalation and the oxygenous gas from the cartridge 50 or 54 is introduced into the flexible tube 64. The mixed gas is then led into the inflow chamber 116 through the inlet 120, and is diffused uniformly throughout the inflow chamber 116 by means of the guide fins 124. After that, the diffused mixed gas goes into inflatable cover member 110 through the absorber plate 130, and subsequently is led into the outflow chamber 118 through the absorber plate 130. The mixed gas is then directed to the outlet 122 by the guide fins 124, and introduced into the flexible tube 66. Accordingly, the flexible tubes 64 and 66 are inflated and thereby being extended by the mixed gas. When the user try to breathe in, the mixed gas in the flexible tubes 64 and 66 and the mechanism 106 is introduced into the influx chamber 28, and is inspired by the user together with the oxygenous gas from the cartridge. In this breathing apparatus, since the mixed gas passes through the absorber plate 130 after it is diffused uniformly throughout the inflow chamber 116, the carbon dioxide is efficiently removed from the mixed gas in spite of the absorber plate 130 of a considerably thin disc-like configuration. Therefore, the ventilation resistance of the carbon dioxide-removing means 106 is maintained at a level considerably lower than that of the carbon dioxide-removing means of the foregoing embodiment, and thereby this breathing apparatus enables a user to breath without difficulty.

While diving using this breathing apparatus, water may accidentally enter the influx chamber 28 through the mouth piece 36. However, since such water is gathered within the receiver section 104, it does not enter the flexible tube 64, and the user while breathing, can easily sense the inflow of the water. Moreover, such water can be easily discharged outside through the purging opening 94 by axially pressing and contracting the inflatable cover member 110 so that the internal pressure of the circular passage is increased to a level higher than the preset pressure.

Figure 10:
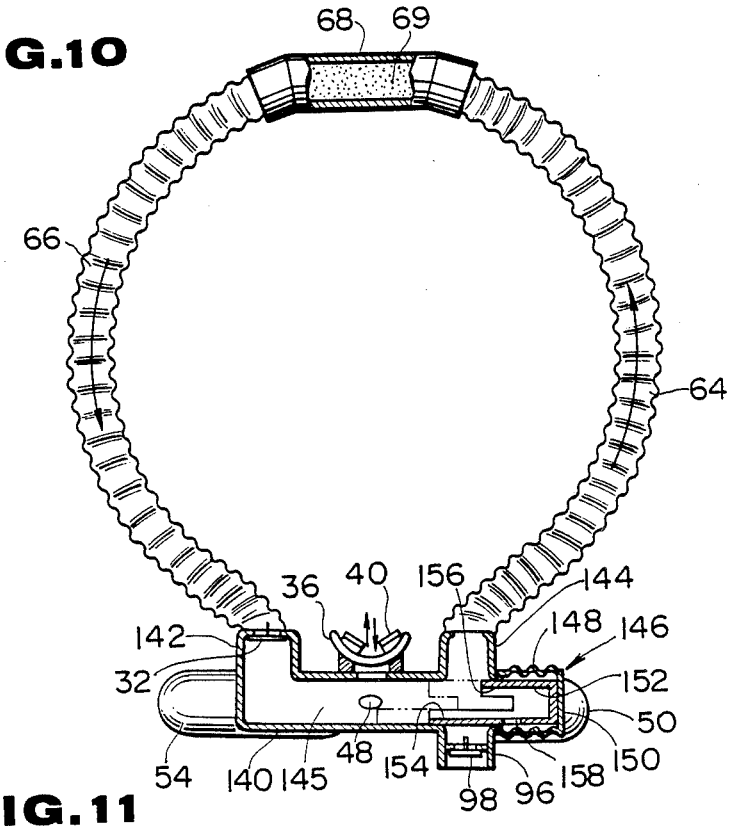
FIG. 10 is a plan view, partly in section, of a further embodiment of the present invention.
Figure 11:
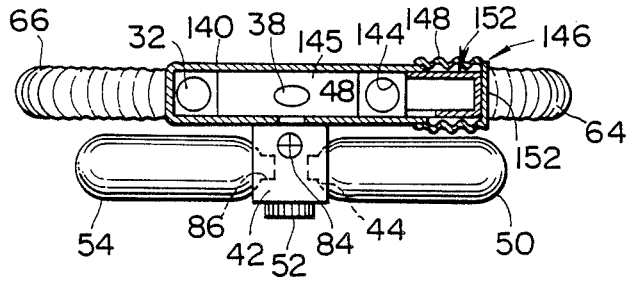
FIG. 11 is a front view, partly in section, of a breathing apparatus in FIG. 10.
Figure 12:
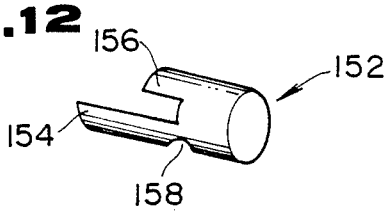
FIG. 12 is a perspective view of a sliding check valve in FIG. 10.

A further embodiment of the present invention is illustrated in FIGS. 10 to 12, in which a tubular vessel member 140 has an open right end and a closed left end. A mouth piece 36 is connected to the intermediate portion of the vessel member 140, and a regulator 42 is connected to the lower outer face of the vessel member 140. An intake pipe 142 is integrally connected at its proximal end to the left end portion of the vessel member 140 in such a manner that the intake pipe 142 projects from the outer face of the vessel member 140 parallel to the mouth piece 36. An outgo pipe 144 is integrally connected at its proximal end to the right end portion of the vessel member 140 in such a manner that the outgo pipe 144 projects from the outer face of the vessel member 140 parallel to the intake pipe 142. An intake check valve 32 is movably disposed in the intake pipe 142 so as to open and close the distal end of the intake pipe 142. That is to say, a substantially U-shaped influx chamber 145 is defined by the vessel member 140 and intake and outgo pipes 142 and 144. The proximal end of a flexible tube 64 is communicatively connected to the distal end of the outgo pipe 144, while the proximal end of the flexible tube 66 is communicatively connected to the distal end of the intake pipe 142.

As best shown in FIG. 10, a purging pipe 96 is connected at its proximal end to that portion of the vessel member's outer face diametrically opposing to the outgo pipe 144. In this purging pipe 96, a purging check valve 98 is movably disposed to open and close the distal end of the purging pipe 96. Furthermore, a substantially cylindrical purge controller 146 is coaxially connected to the open right end of the vessel member 140. This purge controller 146 includes a substantially cylindrical bellows-like side wall 148 and an end wall 150 closing the right end of the cylindrical side wall 148. The side wall 148 is made of a resilient material such as a flexible natural rubber and a flexible synthetic resin, while the end wall 150 is made of a substantially rigid material such as a metal and a rigid synthetic resin. In other words, this purge controller 146 is such that it is axially contracted and brings the end wall 150 to its contracted most position when the internal pressure of the influx chamber 145 becomes lower than the external pressure, and it is axially extended and brings the end wall 150 to its extended most position when the internal pressure of the influx chamber 145 becomes equal to or higher than the external pressure. The purge controller 146 is also contracted when the end wall 150 is manually pressed inward. A substantially cylindrical sliding check valve 152 is fixedly connected at its closed right end to the inner face of the end wall 150 of the controller 146, and is slidably and coaxially received in the vessel member 140. This sliding check valve 152 is made of a substantially rigid material such as a metal and a rigid synthetic resin. As shown in FIG. 12, this sliding check valve 152 has longer and shorter spaced parallel fillets 154 and 156 protruding from the open left end thereof into vessel member 140. The longer fillet 154 is of such a length that the longer fillet 154 closes the proximal end of the purging pipe 96 when the end wall 150 is in its extended most position. While, the shorter fillet 156 is of such a length that the shorter fillet 156 closes the proximal end of the outgo pipe 144 when the end wall 150 is in its contracted most position and opens the same when the end wall 150 is in its extended most position The longer fillet 154 has a purging aperture 158 formed at such a position that the aperture 158 coincides with the proximal end of the purging pipe 96 to open the same when the end wall 150 is brought to its contracted most position.

When the user exhales, the purge controller 146 is extended until the end wall 150 is brought to its extended most position, and thereby the sliding check valve 152 is brought to the position shown by the solid line in FIG. 10 and opens the proximal end of the outgo pipe 144. Therefore, the mixed gas of the exhalation and the oxygenous gas from the cartridge 50 or 54 is led into the flexible tubes 64 and 66 through the outgo pipe 144, resulting in the extension of the flexible tubes 64 and 66. On the other hand, when the user tries to inhale, the purge controller 146 contracts until the end wall 150 is brought to its contracted most position, and thereby the sliding check valve 152 is brought to the position shown by the phantom line in FIG. 10 and closes the proximal end of the outgo pipe 144. Therefore, the mixed gas from which carbon dioxide has been removed, is introduced into the influx chamber 145 through the intake pipe 142, and is inhaled by the user together with the oxygenous gas from the cartridge 50 or 54. This introduction of the mixed gas into the influx chamber 145, naturally, results in the contraction of the flexible tubes 64 and 66. When water accidentally enters the influx chamber 145, the water can be discharged outside by operating the purge controller 146. That is, the end wall 150 of the purge controller 146 is pressed to its contracted most position so that the proximal end of the outgo pipe 144 is closed, and the proximal end of the purging pipe 96 is opened. Then, the user breathes into the influx chamber 145 so that the internal pressure of the influx chamber 145 becomes higher than the external pressure. As a result, the purging check valve 98 is brought to its opened position, and thereby the water in the influx chamber is discharged through the purging aperture 158 and the purging pipe 96. Accordingly, the absorbent 69 in the container 68 is prevented from being damaged by the water, that is, the increase of the ventilation resistance of the absorbent container 68 and the decrease of the carbon dioxide-absorbing property of the absorbent 69 are avoided.

Figure 13:
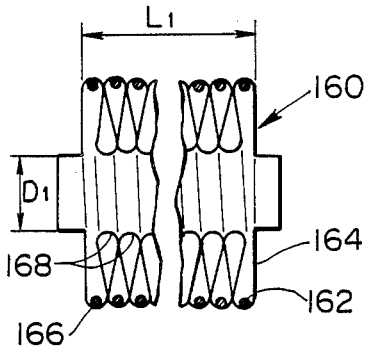
FIG. 13 is an axial-sectional view of a modified form of a flexible tube in FIG. 1, showing the contracted most form of the modified form flexible tube.
Figure 14:
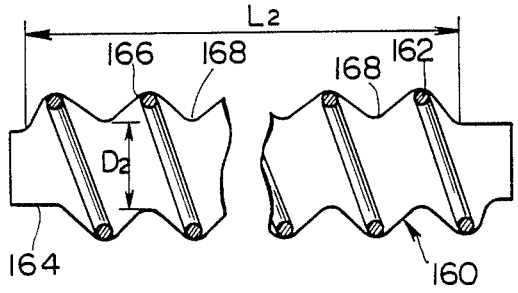
FIG. 14 is an axial-sectional view of the flexible tube in FIG. 13, showing an extended form of the same.
Figure 15:
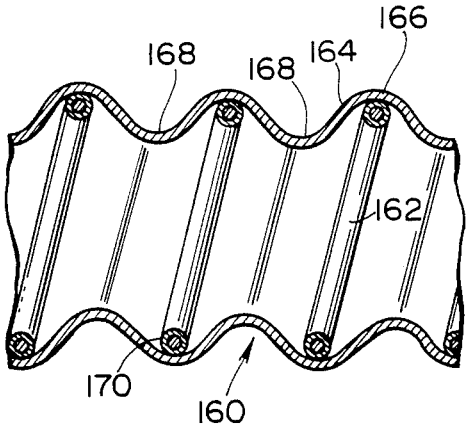
FIG. 15 is an enlarged and fragmentary axial-sectional view of the flexible tube in FIG. 14.

FIGS. 13 to 15 illustrate a modified form of the flexible tube 64 or 66 shown in FIGS. 1, 2 and others. This flexible tube 160 includes a plastic sleeve 164 and a helical tension spring 162 fitting in the plastic sleeve 164. The tension spring 162 is in forcible contact with the inner face of the sleeve 164 and expands the outer diameter of the sleeve 164, resulting in a thread-like helical ridge 166 formed on the outer face of the sleeve 164. That is, the flexible tube 160 is of a corrugated pipe-like construction and is longitudinally extensible and contractible. As shown in FIG. 13, the flexible tube 160 is normally held in its contracted most form of a free length of $L_1$ because of the tension spring 162, and is extended as shown in FIG. 14 when it undergoes an axial tensile load. When the flexible tube 160 is in its contracted most form, any adjoining groove portions 168 of the sleeve 164 shown in FIG. 13 are in contact with each other so that the inner surface area to substantially contact the gas passing through the tube 160, is restricted to the area of the inner surfaces of the groove portions 168. That is, when the flexible tube 160 is not used, it does not gather much dust on its inner face, thus being sanitary. The helical tension spring 162 has a plastic sheath 170 coated thereon, for preventing the tension spring 162 from rusting. This tension spring 162 ensures a radial rigidity of the flexible tube 160, and therefore the flexible tube 160 has a mechanical strength which can resist a considerable external pressure. This flexible tube 160 also has an advantage in that the differential volume between the tube 160 in an extended form and the tube 160 in its contracted most form is considerably large because, when the tube 160 in an extended form of a length $L_2$ is contracted to the tube 160 of the length $L_1$, the minimum inner diameter of the tube 160 is reduced from $D_2$ to $D_1$.

With a breathing apparatus such as shown in FIG. 1, in which the flexible tubes 64 and 66 are replaced by a pair of the flexible tubes 160, a person can breath with less difficulty since, upon his exhaling, the weight or buoyancy of the tubes 160 assists the tubes 160 in longitudinally extending, and upon his inhaling, the tension springs 162 assists the tubes 160 in longitudinally contracting. From this point of view, it is preferred that the spring constant of the tension spring 162 is such that the spring 162 is not a great obstruction to the extension of the tube 160 and is a help to the contraction of the tube 160. More specifically, the tension spring 162 should have a spring constant such that the spring 162 lessens the difference between the internal pressures of the tube 160 and a person's mouth, which is required upon a person's inhaling, to about 0 $cmH_2O$.

In addition to the spring 162, another tension spring may be employed in the flexible tube 160. That is, a helical tension spring may be disposed on the plastic sleeve 164 in such a manner that the spring is disposed along the groove portions 168 of the plastic sleeve 164. Instead of the tension spring 162, a tension spring embedded in the sleeve 164 may be employed.

Figure 16:
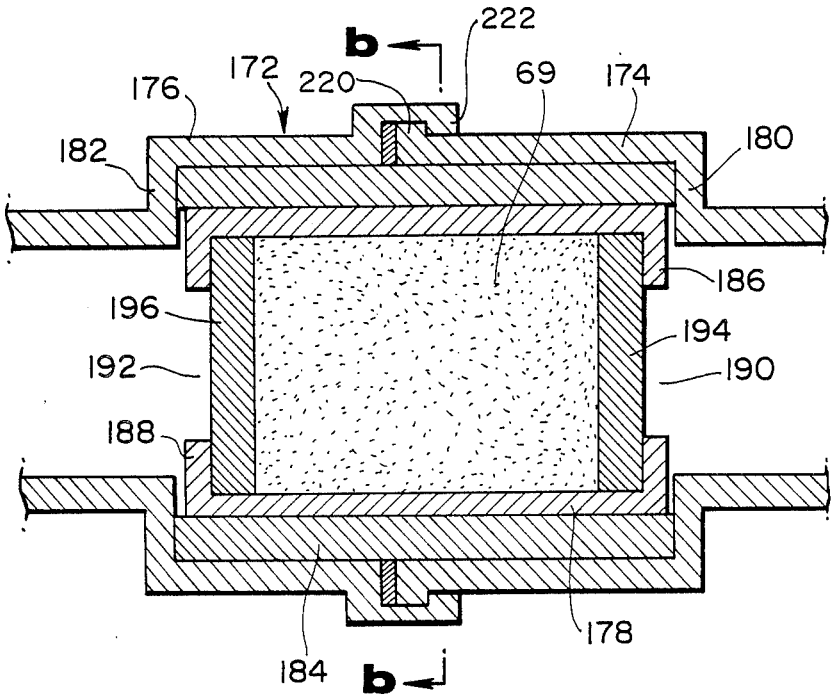
FIG. 16(*a*) is an axial-sectional view of a modified form of a carbon dioxide-absorbing means in FIG. 1.
Figure 16B:
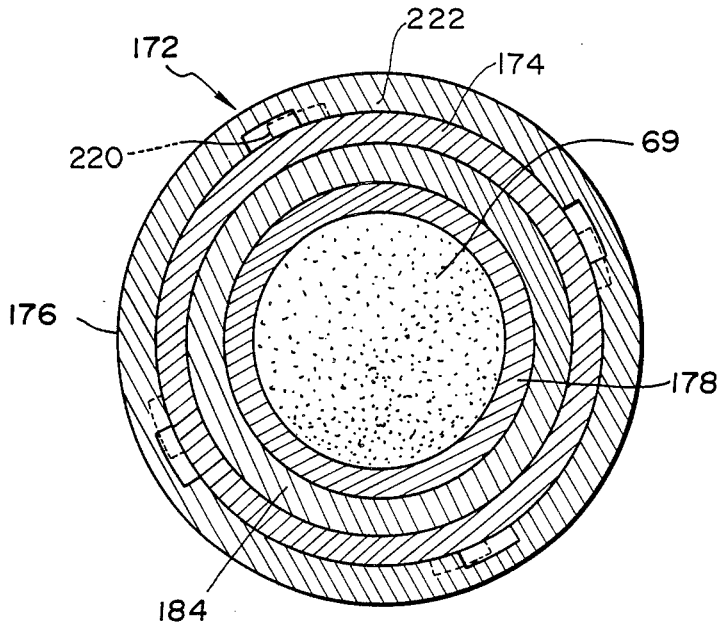

FIGS. 16(*a*) and 16(*b*) show a modified form of the carbon dioxide-removing means in FIG. 1. This removing means 172 includes a pair of hollow cylindrical plastic container members 174 and 176 hermetically engaged at their one open ends coaxially with each other, and a hollow cylindrical absorbent cartridge or canister 178, made of a plastic, coaxially received in the container members 174 and 176. The container members 174 and 176 are connected to each other by means of outer and inner circumferential ridges 220 and 222 formed respectively on the one open ends of the container members 174 and 176. The cartridge 178 is retained in the container members 174 and 176 by means of respective inner flange portions 180 and 182 of the container members 174 and 176, the inner flanges being circumferentially formed on and projecting radially inward from the other open ends of the container members. A hollow cylindrical water-absorbing member 184 is interposed between the absorbent cartridge 178 and the container members in such a manner that the water-absorbing member 184 fits around the absorbent cartridge 178. The absorbent cartridge 178 also has a pair of inner flange portions 186 and 188 projecting radially inward from the opposite ends of the cartridge 178. These inner flanges 186 and 188 define openings 190 and 192 at the opposite ends of the cartridge 178. The openings 190 and 192 of the cartridge 178 are covered respectively with a pair of disk-shaped water-absorbing filters 194 and 196 which fit in the cartridge 178. An absorbent 69 capable of absorbing carbon dioxide is filled within an interior space defined by the inner surface of the cartridge 178 and the filters 194 and 196. The water-absorbing member 184 is made of a resin capable of absorbing water, while each of the water-absorbing filters 194 and 196 is made of a nonwoven fabric with a water-absorbing resin adsorbed thereon.

To employ the removing means 172, for example, in the breathing apparatus shown in FIG. 1, the container members 174 and 176 are coaxially connected respectively with the distal ends of the flexible tubes 64 and 66. Then, the absorbent cartridge 178 with both the absorbent 69 and the water-absorbing member 184 is encased in the container members 174 and 176. In the removing means 172, the carbon dioxide-absorbing power of the absorbent 69 is maintained even if water accidentally comes into the container members, since the water-absorbing member 184 and the filters 194 and 196 insulate the absorbent 69 from moisture or water. If the member 184 and the filters 194 and 196 absorb too much water to allow the user to easily breath, the absorbent cartridge 178 should be replaced with a new one. This replacing operation is very simple since it can be accomplished merely by disengaging and reengaging the container members 174 and 176.

Figure 17:
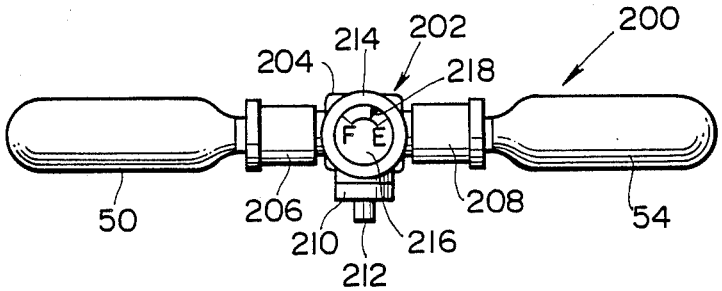
FIG. 17 is a plan view of a modified form of an oxygen-supplying means in FIG. 1.
Figure 18:
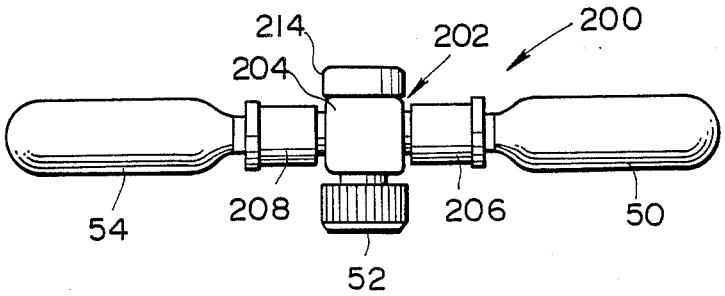
FIG. 18 is a front view of the oxygen-supplying means in FIG. 17.
Figure 19:
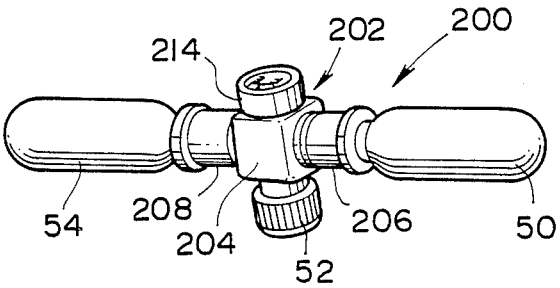
FIG. 19 is a perspective view of the oxygen-supplying means in FIG. 17.

FIGS. 17 to 19 illustrate a modified form of the oxygen-supplying means or mechanism shown in FIGS. 1 and 2. Reference numeral 202 designates a regulator having substantially cubical body 204. This regulator 202 includes a pair of cylindrical connectors 206 and 208 joined to the opposite side faces of the body 204 to detachably connect a pair of oxygen cartridges 50 and 54 to the body 24. More specifically, the threaded and valved ends of the oxygen cartridges 50 and 54 are threadedly engaged with the connectors 206 and 208 respectively. A discharging pipe 210 with a sound emitter such as a whistle 212 is fixedly connected to the rear face, i.e., the lower face, as viewed in FIG. 17, of the body 204. That is, the proximal end of the discharging pipe 210 is attached to the rear face of the body 204, and the whistle 212 is connected to the distal end of the discharging pipe 210. The body 204 has an oxygen-leading passage (not shown) formed therein, the passage communicatively connecting the connectors 206 and 208 to the discharging pipe 210. Therefore, when oxygenous gas is supplied through the passage to the discharging pipe 210 and is discharged from the discharging pipe 210 through the whistle 212, the whistle 212 emits a sound. It is preferred that the whistle 212 is such that it emits a sound when the flow rate of oxygenous gas passing through the whistle 212 is in the range of 0.5 lit./min. to 2.0 lit./min. A regulator check valve (not shown) is disposed within each of the connectors 206 and 208 in order to regulate the flow rate of oxygenous gas flowing from the cartridges 50 and 54 into the discharging pipe 210. A rotatable controlling lug 52 which is disposed on the lower face, as viewed in FIG. 18, of the body 204 is operatively connected to both the check valves in the connecters 206 and 208 so that, by turning the control lug 52, the check valves are opened, and the flow rate of oxygenous gas to be supplied to the discharging pipe 210 is adjusted to a prescribed value. Further, a pressure gage 214 for detecting and indicating an amount of oxygenous gas remaining in the oxygen cartridges 50 and 54 is disposed on the upper face, as viewed in FIG. 18, of the body 204. This pressure gage 214 employs a Bourdon tube (not shown) communicatively connected to the oxygen-leading passage of the body 204. On a dial plate 216 of the pressure gage 214, letters E and F are printed, wherein letter E denotes that the cartridges 50 and 54 are empty or the internal pressure of the cartridges 50 and 54 is a specific level such as 5 kg/cm$^2$ and so on, and letter F denotes that the cartridges 50 and 54 are full of oxygen. A pointer 218 of the pressure gage 214 operatively connected to the Bourdon tube, moves between letter E and F as the internal pressure of the cartridges 50 and 54 varies, thus indicating a residual amount of oxygenous gas in the cartridges 50 and 54.

To use the oxygen-supplying mechanism 200 described above, the mechanism 200 is connected to a breathing apparatus such as the apparatus shown in FIG. 1 instead of the oxygen-supplying means 42 and the like. More specifically, as shown in FIG. 20, an inlet opening is formed in the convex side of a vessel member 20 instead of the inlet opening 48, and then, the discharging pipe 210 is fixedly inserted into the inlet opening of the vessel member 20.

Figure 20:
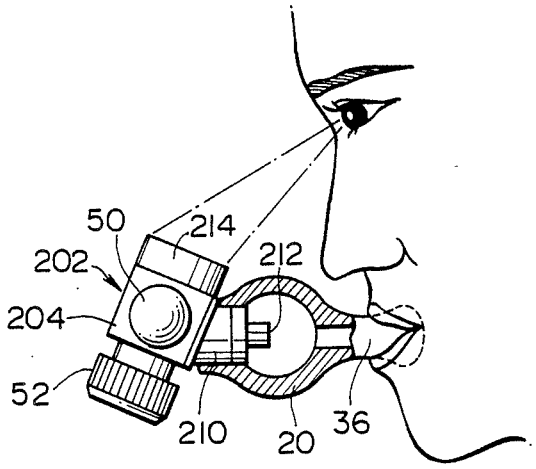
FIG. 20 is a fragmentary cross-sectional view of a breathing apparatus in which the modified form oxygen-supplying means in FIG. 17 is employed, showing a state of the oxygen-supplying means connected to a vessel member.

In operation of the breathing apparatus with the mechanism 200 shown in FIG. 20, the control lug 52 is turned until the whistle 212 begins to emit a sound, and then the mouth piece 36 is taken in a person's mouth in such a manner that the pressure gage 214 faces the person's eyes. While the mouth piece is in his mouth and the whistle emits the sound, the sound is transmitted to the labyrinths of the person via his skull. Therefore, the person can easily sense the sound without using his external ears. In other words, it is possible for the user of the apparatus to be aware of the oxygenous gas running out or of the regulator 202 in trouble when the whistle stops emitting the sound. Moreover, since the pressure gage 214 face the user's eyes, it is possible for the user to confirm an amount of oxygenous gas remaining in the cartridges 50 and 54.

EXAMPLE 1

A test breathing apparatus equivalent to the foregoing modified form shown in FIGS. 4 and 5 was prepared. 170 g of BARALYME having a main component of LiOH was filled within the absorbent container 68, and 95 ml of a mixed gas of oxygen and nitrogen compressed to 190 atmospheres was charged into each of the cartridges 50 and 54. Silicone rubber tubes having 50 mm nominal diameters were used as flexible tubes 64 and 66, and PVC tubes having 55 mm nominal diameters were used as outer safeguard tubes 78 and 80. The sum of the maximum capacities of both the silicone rubber tubes was not less than 3 liters and not more than 5 liters. As intake and outgo check valves 32 and 34, mushroom-type valves having 20 mm diameters were employed. The flow rate of the mixed gas supplied to the influx chamber 28 was adjusted to 1.5 liter/min.

The breathing apparatus mentioned above was communicatively connected at its mouth piece to a spirometer to achieve a simulation test. More specifically, carbon dioxide including 4 to 5% of air was supplied, by using the spirometer, to the breathing apparatus at a flow rate of 1 lit./min. for about 20 minutes. After that, the partial pressure of the carbon dioxide in the gas remaining in the flexible tube 66 was measured by using a $CO_2$ analyzer. The result was that the partial pressure of the carbon dioxide was less than 0.005 atmospheres. This result means that the breathing apparatus has a satisfying property as a respirator. Also, the same breathing apparatus was used by an average person for respiration. The result proved that an average person can breath by using the apparatus for about 20 minutes at atmospheric pressure and for more than 10 minutes at the water pressure in a water depth of 5 m.

EXAMPLE 2

A test breathing apparatus equivalent to the foregoing embodiment shown in FIGS. 10 to 12 was prepared. The same absorbent of the same quantity as the one in Example 1 was charged in the container 68. The same mixed gas of the same condition as Example 1 was filled within each of the cartridges 50 and 54. A silicone rubber flexible tube having an inner diameter of 33 mm was used as a purge controller 146, and a ABS resin tube having an outer diameter of 30 mm was used as a sliding check valve 152. As intake and purging check valves 32 and 98, mushroom-type valves having 20 mm diameters were employed. The flow rate of the mixed gas supplied to the influx chamber 145 was adjusted to 1 liter/min.

The breathing apparatus mentioned above was connected to a spirometer in the same manner as Example 1, and carbon dioxide under the same condition as Example 1 was supplied to the breathing apparatus at a flow rate of 1 lit./min. for about 20 minutes. After that, the partial pressure of the carbon dioxide in the gas remaining in the flexible tube 66 was measured by using a $CO_2$ analyzer. The result was that the partial pressure of the carbon dioxide was less than 0.005 atmospheres. This result means that the breathing apparatus has a satisfying property as a respirator.

While diving using this breathing apparatus, water was intentionally introduced into the influx chamber 145. Then, the end wall 150 of the purge controller 146 was pressed inward, and air was exhaled into the influx chamber 145 through the mouth piece 36. The result was that the water in the influx chamber 145 was easily discharged from the purging pipe 96. The absorbent container 68 was also checked after the apparatus was taken out of the water. The result was that there was no inflow of the water into the container 68.

EXAMPLE 3

A test breathing apparatus such as the foregoing embodiment shown in FIGS. 10 and 11 was prepared. In this apparatus, the flexible tube 64 and 66 were replaced by flexible tubes, each being equivalent to the tube 160 in FIGS. 13 to 15. Each flexible tube 160 in its contracted most form had respective outer and inner diameters of 55 mm and 43 mm and had a length of 250 mm. When each flexible tube 160 was inflated with a gas at a gage pressure of 15 $cmH_2O$, the elongation rate of the tube was 300%. A coil tension spring of a wire diameter from 0.9 mm to 1.2 mm and of a spring constant from 0.5 kg/mm to 3.0 kg/mm was used as the spring 162. A sleeve made of a soft vinyl chloride resin was used as the sleeve 164. The volume of the tube 160 in its contracted most form was 900 cc, while the volume of the tube 160 extended 300% in length was 3900 cc. The dead space of the circular piping, i.e., the volume of the tubular member 140 was about 50 cc.

The apparatus mentioned above was used for a person to breath in atmosphere while the flexible tubes 160 were subjected to a tension due to their own weights. Meanwhile, the differential pressure, that is, the difference between the internal pressures of the tubes 160 and the person's mouth was measured. The result was that the differential pressure, when the person inhaled, was approximately 5 $cmH_2O$ while the differential pressure, when the person exhaled, was about 0 $cmH_2O$.

In addition to the test mentioned above, the same apparatus was used in a water under a gage pressure of 1.5 $kg/cm^2$, which is a pressure equivalent to the water pressure at a water depth of 15 m. While the apparatus was being used, the flexible tubes 160 were subjected to a tension due to their own buoyancies. Meantime, the differential pressure was measured in the same manner as the foregoing test. The result was that the differential pressure upon the person's inhaling was about 10 $cmH_2O$ while the differential pressure upon his exhaling was about 0 $cmH_2O$.

EXAMPLE 4

A test carbon dioxide-removing mechanism equivalent to the mechanism 172 in FIGS. 16(*a*) and 16(*b*) was prepared. This mechanism included: a plastic absorbent cartridge 178 of a 60 mm outer diameter and an 80 mm length; a pair of filters 194 and 196 of a 55 mm diameter and a 5 mm thickness; and 170 g of HP SODASORB which is able to absorb carbon dioxide at a partial pressure of less than 0.01 ata for 30 min.

The aforementioned mechanism 172 was connected to a breathing apparatus such as shown in FIG. 1 instead of the mechanism 68, and the breathing apparatus was used for a person to breath in water at a temperature of 28° C. to 30° C. or in seawater at a temperature of 11° C. to 15° C. Then, the mouth piece 36 was intentionally released from the person's mouth and was kept out of the mouth for about 5 to 6 seconds. After the apparatus was taken out of the water, the cartridge 178 was taken out of the container members 174 and 176 and then, the carbon dioxide absorbent 69 was analyzed to find out if the absorbent 69 had absorbed any moisture. The result was that neither moisture absorption of the absorbent 69 nor alkaline water exuded from the absorbent 69, was detected.

EXAMPLE 5

A test oxygen-supplying mechanism equivalent to the mechanism 200 shown in FIGS. 17 to 19 was prepared. A regulator check valve was employed in each of the connectors 206 and 208, the check valve being capable of reducing a gage pressure of a gas between 190 $kg/cm^2$ and 5 $kg/cm^2$ to a gage pressure of about 2 $kg/cm^2$ and being capable of regulating the flow rate of a gas to a level between 1.5 lit./min. to 1.9 lit./min. A pressure gage of a 30 mm outer diameter and a 5 mm thickness was used as the pressure gage 214. This pressure gage was of a rotating disc indication type of which angle of rotation is in the range of 10° to 85°. Also, this pressure gage was such that the pointer of the pressure gage indicated letter E on its dial plate when the pressure detected was 5 $kg/cm^2$. A whistle was used as the sound emitter 212, the whistle being capable of emitting a sound when the flow rate of a gas passing therethrough was between 0.5 lit./min. to 2.0 lit./min.

The test oxygen-supplying mechanism described above was connected to a breathing apparatus as shown in FIG. 20, and was used for a person to breath in atmosphere. Meantime, the operational conditions of the pressure gage and the whistle were checked. The result was that both the whistle and the pressure gage worked well, thereby confirming the person of a residual amount of oxygenous gas in the oxygen cartridges.

The test mechanism connected to the breathing apparatus was also used in water, and was analyzed to find out if it is possible for the person to sense the sound of the whistle. The result was that the sound of whistle was transmitted very well to the person's labyrinths via his skull, which confirmed that the user of this mechanism could sense the sound of the whistle in water.

What is claimed is:

1. A breathing apparatus enabling a person to function in irrespirable fluids, the breathing apparatus comprising:

a mouth piece adapted to be taken in the mouth of the person;

a vessel member connected to the mouth piece and having an internal influx chamber communicating with the mouth piece, the vessel member having intake and outgo ports communicating with the influx chamber;

communication means having opposite ends connected respectively to the intake and outgo ports of the vessel member in such a manner that the vessel member and the communication means form a loop in which a circular passage for a respirable gas is defined, the loop being adapted to be loosely worn around the person's body;

oxygen-supplying means for supplying the circular passage with the respirable gas;

intake and outgo check valves, disposed respectively at the intake and outgo ports of the vessel member, for limiting the flow of the respirable gas in the circular passage to a single direction so that, when the person exhales the respirable gas into the influx chamber through the mouth piece, the respirable gas is introduced into the communication means through the outgo port and, when the person inhales through mouth piece, the respirable gas in the communication means is recycled into the influx chamber through the intake port; and an outlet port for discharging excess respirable gas out of the circular passage, the communication means comprising:

(a) first and second inflatable flexible tubes for receiving the respirable gas upon the person exhaling the respirable gas into the circular passage, and for releasing the respirable gas to the influx chamber upon the person inhaling through the mouth piece, the first and second flexible tubes being adapted to be worn respectively on the person'opposite shoulders, each of the first and second flexible tubes being of a cylindrical bellows-like construction and being longitudinally extensible and contractible to respectfully increase and decrease the internal volume thereof, each of the first and second flexible tubes having proximal and distal ends, the proximal ends of the first and second flexible tubes being communicatively connected respectively to the intake and outgo ports of the vessel member, the distal ends of the first and second flexible tubes being communicatively connected to each other, the first and second flexible tubes longitudinally extending in response to the person exhaling to receive the respirable gas exhaled by the person, the flexible tubes longitudinally contracting in response to the person inhaling so as to decrease in internal volume as the respirable gas is withdrawn therefrom, whereby said flexible tubes define a reservoir for respirable gas which varies in volume in response to exhaling and inhaling by the person; and (b) carbon dioxide-removing means for removing carbon dioxide from the respirable gas passing through the communication means.

2. A breathing apparatus according to claim 1, wherein the loop formed by the communication means and the vessel member is of an inner diameter larger than the transverse outer size of the person's neck when the first and second flexible tubes are most contracted, and wherein the difference between the maximal volume of the flexible tubes in their longitudinally extended most forms and the minimal volume of the flexible tubes in their longitudinally contracted most forms is larger than the volume of a normal inhalation or exhalation of the person.

3. A breathing apparatus according to claim 2, wherein the oxygen-supplying means comprises: an oxygen cartridge attached to the vessel member and containing a high-pressure respirable gas, the oxygen cartridge having an outer size considerably smaller than the vessel member; and a regulator, directly attached to the vessel member and communicatively interconnecting the oxygen cartridge with the vessel member, for regulating the flow rate of the respirable gas which is to be supplied to the circular passage by the oxygen cartridge, the oxygen cartridge being detachably connected to the regulator.

4. A breathing apparatus according to claim 3, wherein the regulator comprises an upper face which faces the person's eyes when the mouth piece is taken in the person's mouth, and a pressure gage, disposed on the upper face thereof, for indicating an amount of respirable gas remaining in the oxygen cartridge, the pressure gage communicatively connected to the oxygen cartridge.

5. A breathing apparatus according to claim 4, wherein the vessel member further has a purging port in communication with the influx chamber, for allowing water accidentally entering the influx chamber to go out of the circular passage, the purging port including a purging check valve movably disposed therein for opening and closing the purging port, the purging check valve being normally held in its closed position and being brought to its opened position when the internal pressure of the influx chamber becomes higher than the external pressure.

6. A breathing apparatus according to claim 5, wherein the purging port further includes a purging opening disposed on the vessel member at a position confronting the mouth piece, and wherein the vessel member further has: an inner face defining the influx chamber; and a cofferdam wall disposed on the inner face of the vessel member so as to surround the purging opening, the cofferdam wall defining therewithin a receiver section for gathering water accidentally coming into the influx chamber through the mouth piece.

7. A breathing apparatus according to claim 5, further comprising a purge controller for operating the purging check valve, the purge controller including: a substantially cylindrical side wall axially extensible and contractible and having proximal and distal ends, the proximal end of the side wall being communicatively connected to the vessel member; and an end wall closing the distal end of the side wall thereby, as the side wall extends and contracts, moving between its extended most position and its contracted most position, the side wall being normally extended so that the end wall is held in its extended most position whereby when the end wall is manually pressed toward its contracted most position, the internal pressure of the influx chamber increases to a level higher than the external pressure, resulting in the purging check valve being brought to its opened position.

8. A breathing apparatus according to claim 7, wherein the purge controller has means for contracting the side wall of the purge controller so that when the person inhales, the side wall of the purge controller is contracted until the end wall of the purge controller is brought to its contracted most position, and wherein the outgo check valve is operatively connected to the end wall of the purge controller in such a manner that the outgo check valve is brought to its opened position when the end wall of the purge controller is brought to its extended most position, and the outgo check valve is brought to its closed position when the end wall is brought to its contracted most position.

9. A breathing apparatus according to claim 8, wherein the outgo check valve includes an auxiliary purging check valve portion for opening and closing the purging port, the auxiliary purging check valve portion being held in its closed position when the end wall of the purge controller is in its extended most position, the auxiliary purging check valve portion being brought to its opened position when the end wall of the purge controller is brought to its contracted most position, whereby when the end wall is manually pressed toward its contracted most position, the auxiliary purging check valve portion is brought to its opened position and also the internal pressure of the influx chamber increases to a level higher than the external pressure, resulting in the purging check valve being brought to its opened position.

10. A breathing apparatus according to claim 9, wherein the carbon dioxide-removing means interconnects the distal ends of the first and second flexible tubes, the carbon dioxide-removing means comprising: a substantially tubular container member communicatively connected at its opposite ends respectively to the distal ends of the first and second flexible tubes; a carbon dioxide-absorbing agent received within the container member, the absorbing agent being capable of absorbing carbon dioxide; and water-absorbing means, enclosing the absorbing agent, for absorbing water accidentally coming into the container member and for insulating the absorbing agent from the water.

11. A breathing apparatus according to claim 10, wherein the carbon dioxide-removing means further comprises a substantially tubular absorbent cartridge coaxially fitting in the container member, wherein the water-absorbing means comprises: a water-absorbing material interposed between the container member and the absorbent cartridge in such a manner that the material peripherally encloses the absorbent cartridge; and a pair of water-absorbing filters covering the opposite open ends of the absorbent cartridge, and wherein the carbon dioxide-absorbing agent is filled within the absorbent cartridge.

12. A breathing apparatus enabling a person to function in irrespirable fluids, the breathing apparatus comprising:

a mouth piece adapted to be taken in the mouth of the person;

a vessel member connected to the mouth piece and having an internal influx chamber communicating with the mouth piece, the vessel member having intake and outgo ports communicating with the influx chamber, the vessel member further having a purging port in communication with the influx chamber, for allowing water accidentally entering the influx chamber to go out of the circular passage, the purging port including a purging check valve movably disposed therein for opening and closing the purging port, the purging check valve being normally held in its closed position and being brought to its opened position when the internal pressure of the influx chamber becomes higher than the external pressure the purging port further including a purging opening disposed on the vessel member at a position confronting the mouth piece, and wherein the vessel member further has: an inner face defining the influx chamber; and a cofferdam wall disposed on the inner face of the vessel member so as to surround the purging opening, the cofferdam wall defining therewithin a receiver section for gathering water accidentally coming into the influx chamber through the mouth piece;

communication means having opposite ends connected respectively to the intake and outgo ports of the vessel member in such a manner that the vessel member and the communication means form a loop in which a circular passage for a respirable gas is defined, the loop being adapted to be loosely worn around the person's neck;

oxygen-supplying means for supplying the circular passage with the respirable gas, said oxygen-supplying means including an oxygen cartridge attached to the vessel member and containing a high-pressure respirable gas, the oxygen cartridge having an outer size considerably smaller than the vessel member; and a regulator, directly attached to the vessel member and communicatively interconnecting the oxygen cartridge with, for regulating the flow rate of the respirable gas which is to be supplied to the circular passage by the oxygen cartridge, the oxygen cartridge being detachably connected to the regulator, the regulator including an upper face which faces the person's eyes when the mouth piece is taken in the person's mouth, and a pressure gage, disposed on the upper face thereof, for indicating an amount of respirable gas remaining in the oxygen cartridge, the pressure gage communicatively connected to the oxygen cartridge;

intake and outgo check valves, disposed respectively at the intake and outgo ports of the vessel member, for limiting the flow of the respirable gas in the circular passage to a single direction so that, when the person exhales the respirable gas into the influx chamber through the mouth piece, the respirable gas is introduced into the communication means through the outgo port and, when the person inhales through mouth piece, the respirable gas in the communication means is recycled into the influx chamber through the intake port; and an outlet port for discharging excess respirable gas out of the circular passage, the communication means comprising:

(a) first and second inflatable flexible tubes for receiving the respirable gas upon the person exhaling the respirable gas into the circular passage, and for releasing the respirable gas to the influx chamber upon the person inhaling through the mouth piece, the first and second flexible tubes being adapted to be worn respectively on the person's opposite shoulders, each of the first and second flexible tubes being of a cylindrical bellows-like construction and being longitudinally extensible and contractible, each of the first and second flexible tubes having proximal and distal ends, the proximal ends of the first and second flexible tubes being communicatively connected respectively to the intake and outgo ports of the vessel member, the distal ends of the first and second flexible tubes being communicatively connected to each other, the first and second flexible tubes longitudinally extending when the flexible tubes receive the respirable gas exhaled by the person, the flexible tubes longitudinally contracting when the flexible tubes release the respirable gas to the influx chamber; and (b) carbon dioxide-removing means for removing carbon dioxide from the respirable gas passing through the communication means;

the loop formed by the communication means and the vessel member having an inner diameter larger than the transverse outer size of the person's neck when the first and second flexible tubes are most contracted, and the difference between the maximal volume of the flexible tubes in their longitudinally extended most forms and the minimal volume of the flexible tubes in their longitudinally contracted most forms is larger than the volume of a normal inhalation of exhalation of the person;

the carbon dioxide-removing means interconnecting the distal ends of the first and second flexible tubes, the carbon-dioxide removing means comprising: a container member including a bottom wall, a peripheral wall, an open top and a partition wall, the partition wall being formed on the bottom wall in such a manner that the partition wall divides the internal space of the container member into inflow and outflow chambers, the peripheral wall having an inlet and an outlet communicating with the inflow and outflow chamber respectively, the inlet and the outlet being communicatively connected to the distal ends of the first and second flexible tubes respectively; a cover member defining therein an air chamber and communicatively connected to the open top of the container member so that the inflow chamber is in communication with the outflow chamber through the air chamber; and a plate-like absorbing member made of an absorbing agent capable of absorbing carbon dioxide, the absorbing member being interposed between the air chamber and the internal space of the container member so that the inflow and outflow chambers are in communication with the air chamber through the plate-like absorbing member, the cover member including a cylindrical bellow-like side wall with a closed end and an open end, the open end of the side wall of the cover member being connected to the open top of the container member, the side wall of the cover member being axially extensible and contractible and being normally maintained in its extended most configuration, whereby when the side wall of the cover member is manually contracted, the internal pressure of the circular passage is increased to a level higher than the external pressure, resulting in the purging check valve in the purging port of the vessel member being brought to the opened position.

13. A breathing apparatus according to claim 12, wherein the container member further includes a plurality of guide fins disposed on the bottom wall thereof, the fins extending in directions substantially intersecting the partition wall of the container member in such a manner that the distance between any two adjoining fins is gradually lengthened as the fins extend toward the partition wall.

14. A breathing apparatus according to claim 9 or 13, further comprising a pair of outer safeguard tubes coaxially encasing the flexible tubes respectively, the outer safeguard tubes being longitudinally extensible and contractible together with the flexible tubes, each of the safeguard tubes having a plurality of through apertures formed in the outer face thereof.

15. A breathing apparatus according to claim 9 or 13, wherein the regulator further comprises a discharging port through which the respirable gas from the oxygen cartridge is supplied to the circular passage, and a sound emitter disposed at the discharging port, the sound emitter emitting a sound when the flow rate of the respirable gas passes through the discharging port is a level in a predetermined range.

16. A breathing apparatus according to claim 9 or 13, wherein each of the flexible tubes comprises a sleeve member having a thread-like helical ridge formed on the outer face thereof, and a helical tension spring member fitting in the sleeve member in such a manner that the spring member is disposed along helical ridge of the sleeve member.

* * * * *